US005731666A

United States Patent [19]

Folker et al.

[11] Patent Number: 5,731,666

[45] Date of Patent: Mar. 24, 1998

[54] INTEGRATED-MAGNETIC FILTER HAVING A LOSSY SHUNT

[75] Inventors: Don V. Folker; Bryce L. Hesterman, both of Fort Wayne; Dan Soule, Huntington; George W. Mortimer, Fort Wayne, all of Ind.

[73] Assignee: Magnetek Inc., Nashville, Tenn.

[21] Appl. No.: 613,217

[22] Filed: Mar. 8, 1996

[51] Int. Cl.[6] ..... H05B 41/16

[52] U.S. Cl. ..... 315/276; 315/278; 336/165; 336/178; 336/181

[58] Field of Search ..... 333/181, 177, 333/185; 315/276, 278, 241 R, 243–245; 336/160, 165, 178, 181, 212, 214

[56] References Cited

U.S. PATENT DOCUMENTS

| | | | |
|---|---|---|---|
| 4,088,942 | 5/1978 | Miko | 336/160 X |
| 4,202,031 | 5/1980 | Hesler et al. | 363/97 |
| 4,422,056 | 12/1983 | Roberts | 315/239 X |
| 4,654,563 | 3/1987 | Boyd | 315/244 |
| 4,902,942 | 2/1990 | El-Hamamsy | 315/276 |
| 5,083,101 | 1/1992 | Frederick | 333/181 |
| 5,119,059 | 6/1992 | Covi | 336/175 |
| 5,187,428 | 2/1993 | Hutchison et al. | 336/160 X |
| 5,313,176 | 5/1994 | Upadhyay | 333/181 |
| 5,525,951 | 6/1996 | Sunano et al. | 336/160 X |

OTHER PUBLICATIONS

Siemens Components Application Notes, Arminn Schweiger, Nov. 1995, p. 27.

Micrometals Power conversion and Line Filter Catalog 4 Issue G p. 10.

*Primary Examiner*—Robert Pascal
*Assistant Examiner*—Haissa Philogene
*Attorney, Agent, or Firm*—Mark P. Bourgeois

[57] ABSTRACT

A two-winding, integrated-magnetic EMI filter provides damped common-mode and differential-mode inductances. The preferred embodiment of the filter has a magnetic core structure that incorporates a high-permeability C-core, a high-permeability I-core, and a low-permeability, lossy shunt. The three core pieces are assembled so as to form a structure that, similar to an E-I configuration, has two winding windows. The loss in the shunt aids in dissipating noise and it diminishes the effects of unwanted parasitic resonances by providing damping for the differential-mode inductance. Damping for the common-mode inductance is provided by losses in the C and I core pieces. Varying the reluctance of the shunt allows the differential-mode inductance to be adjusted separately from the common-mode inductance in order to tune the filter to remove desired noise frequencies. Another embodiment of the invention incorporates a high-permeability toroid core and a low-permeability, lossy shunt.

6 Claims, 4 Drawing Sheets

INTEGRATED-MAGNETIC FILTER HAVING A LOSSY SHUNT

BACKGROUND OF THE INVENTION

This invention is related to electromagnetic interference (EMI) filters used in power electronic devices such as electronic ballasts and switch-mode power supplies. More specifically, it relates to integrated-magnetic filters that provide both common-mode and differential mode inductance. The invention is also related to filter inductors having cores composed of more than one material.

Power electronic devices generate radio frequency noise that can be conducted to the output leads or back through the power line. This noise may interfere with the operation of other electronic equipment. In addition, the normal operation of power electronic devices can be disturbed by noise and transients present on the power supply line. It is therefore desirable to place a filter at the input of these devices in order to provide a level of isolation between the device and the power system. It may also be desirable to place a filter at the output of some power electronic devices.

EMI noise currents can be described in terms of differential-mode and common-mode noise components. Differential-mode noise components consist of currents of equal magnitude flowing in opposite directions in the supply and return lines. Common-mode noise components consist of currents of equal magnitude flowing in the same direction in both the supply and return lines. The return path for common-mode currents is a ground connection.

Differential-mode noise is typically filtered by placing one or more inductors in series with the supply line, the return line or both. Common-mode noise is usually filtered by placing a pair of coupled inductors wound on the same core in series with the supply and return lines. In order to save space and reduce cost, integrated-magnetic filters which provide both common-mode and differential-mode noise attenuation have been devised. Prior-art integrated-magnetic filters are prone to having high-Q parasitic resonances, and they may be difficult to manufacture.

FIGS. 1A and 1B illustrate the general structure and operation of a prior art integrated common-mode-differential-mode EMI inductor, 10. A core structure 11 has two outer legs or core segments 8 and 9, which have no deliberate gap. A center leg composed of core segments 14 and 15 contains a deliberate air gap, 16, and defines two windows, 17 and 18, in the core. The core is illustrated as if composed of two cores shaped like the letter E. In practice, the same general behavior can be obtained with other shapes, such as an E-I core, or a toroid with a core segment across an inner diameter. There are two identical windings, 12 and 13, one on each outer leg. For illustration purposes, these windings are shown around the outer legs of the core. In practice, each winding may be placed in any position which allows the turns to encircle the outer core structure and pass through only one window, 17 or 18, as shown. For illustration purposes, these windings are shown as having four turns each. In practice, each winding may have many turns, or one turn, depending on the application.

FIG. 1A shows the relative direction of a common-mode noise current Ic in the two windings. (Since these noise currents are alternating currents, the directions change during a period, but the relative directions remain the same.) The common-mode current in each winding passes through a core window, going from front to back of the core: the current in winding 12 through window 17, and that in winding 13 through window 18. The associated magnetic fluxes in the core add in a flux path through the outer legs, and subtract in the center leg. The net common-mode flux thus encircles both windows, with no flux in the center leg, as shown by the dashed line Fc1 representing the flux in the core in FIG. 1A.

FIG. 1B shows the relative direction of a differential noise current Id in the two windings. The differential current in winding 12 passes through core window 17, going from front to back, while the current in winding 13 passes through core window 18 from back to front. Magnetic fluxes, shown by dashed lines Fd1 and Fd2, are produced by current Id in windings 12 and 13. The net differential-mode flux encircles each window, with twice the flux in the center leg as in each outer leg.

Such integrated-magnetic assemblies are often used to filter unwanted high frequency noise on conductors which carry low frequency (e.g. 60 Hz ac input line) or dc power to electronic devices or equipment. Thus, these integrated-magnetic assemblies must provide filtering for common and differential noise while accommodating the differential current delivering power. In general, the larger the inductance for each mode, the larger the attenuation provided for the noise. The desire is then to increase both the differential and common-mode inductance an integrated-magnetic assembly, in order to provide the increased noise attenuation. However, since the differential flux path must accommodate flux associated with the power flow, while the common-mode need not, the design considerations for the two inductances are different..

The common-mode inductance in an integrated-magnetic assembly is obtained using a flux path around both windows, as illustrated in FIG. 1A. The inductance associated with this path increases directly with increasing permeability of the core material in this path. For a given material, it is maximum if there are no air gaps in the path. Therefore, for increased noise attenuation, a common-mode flux path will be formed of high-permeability material arranged to form an ungapped flux path.

The differential-mode inductance in an integrated-magnetic assembly is obtained using the flux path through the center leg, as illustrated in FIG. 1B. This magnetic flux path must accommodate the flux from the ac line or dc power without exceeding the saturation flux density of any material in the flux path. A standard practice in the design of a differential inductor is to introduce an air gap to limit the flux. An air gap increases the reluctance of the flux path, that is, decreases the ease with which flux flows in the path. This increased reluctance allows less flux to flow for a given current in the windings, and thus helps to keep the flux density level below the saturation level of the materials, but reduces the inductance, compared to an ungapped path.

The concept of magnetic reluctance is familiar to magnetic component designers and may be regarded as an indication of the difficulty with which magnetic flux passes through a volume of material. It is instructive to examine an expression for reluctance, since the term is used repeatedly in the description of prior art and the present invention. In general, the reluctance of a portion of a flux path is determined by its geometry and the permeability μ of the material in the path. Specifically, the reluctance is given by $$reluctance = length/(\mu \times area),$$

where the length is measured parallel to the magnetic flux direction, and the area is the cross-sectional area through which the magnetic flux flows. The total reluctance of a flux path is then the sum of all the portions of the path through which the flux passes in series. Of special interest is the dependence of the reluctance on the material permeability: the lower the permeability, the higher the reluctance. Since air has a relative permeability of 1, compared to several thousand for ferrite materials, the introduction of an air gap in series in a flux path adds significant reluctance to the path.

The concept of reluctance is useful in the description of an integrated filter inductor, which presents a new situation when compared to the use of separate common-mode and differential-mode components. In an integrated inductor, common-mode and differential-mode fluxes share some flux paths. This situation is illustrated in FIGS. 1A and 1B, in which the outer legs carry both differential flux Fd1 or Fd2 and common-mode flux Fc1. The material in the common-mode flux path is expected to be a high-permeability material in an ungapped path, as described above, in order to achieve effective common-mode noise attenuation. Such a path has, by design, very low magnetic reluctance. Any increase in reluctance introduced by an air gap must then be positioned in the center leg portion of the differential flux path, in order to avoid reducing the magnitude of the common-mode inductance. This added reluctance in the center leg reduces the differential-mode inductance, but allows differential dc or ac line current to flow in the windings without saturating any portion of the core.

In structures such as the ones shown in FIGS. 1A and 1B, the low reluctance, uniform, ungapped, path around both windows provides high common-mode inductance. In this path, the magnetic field associated with common-mode noise is distributed nearly uniformly along the length of flux path, and the stored energy associated with this field is thus distributed fairly uniformly throughout the volume of the core forming this path. The entire common-mode field then is subjected to any damping or dissipation due to the material properties. This dissipation can serve to further increase the attenuation of common-mode noise, by providing resistive as well as inductive impedance, and by damping or lowering the Q of any parasitic resonance in the assembly or associated filter.

The differential flux path is not uniform, but is composed of a low reluctance portion in high-permeability material, and a high reluctance portion through the air gap in the center leg. The energy stored in a magnetic field associated with a differential current is concentrated in the high reluctance portion, the air gap. For flux paths designed with an air gap, the total stored energy is so dominated by the fraction of energy in the gap that an accepted practice is to approximate the inductance with an expression involving only the air gap volume only, neglecting the core material entirely. Since air has negligible magnetic loss, these gapped paths, with the energy stored in air, provide circuit impedances which have an inherently high Q. Thus prior-art integrated filter inductors that use a single magnetic material and an air gap in the differential flux path are not able to use the magnetic material properties to provide dissipative attenuation or to damp parasitic resonances for differential-mode noise.

Prior-art integrated-magnetic filter inductor assemblies are some variation on the structure in FIGS. 1A and 1B, having a core composed entirely of a single high-permeability material, chosen to obtain a large common-mode inductance, and having a gap required to accommodate a power current. U.S. Pat. No. 5,313,176 to Upadhyay shows a core assembly using an E-I core, with the two windings positioned on the I portion of the core, spaced to fit into the separate windows. The accommodation of a differential power current on the lines to be filtered is not expressly discussed, but could be accomplished by adjustment of the gap or gaps, thereby limiting the differential inductance or both common and differential inductances. Because of the air gap in the center leg, this type of filter does not provide damping for the differential-mode inductance. An additional disadvantage of this structure is that the air gap in the center leg is often large enough that creating it may require multiple grinding passes.

A similar assembly is shown in U.S. Pat. No. 5,119,059 to Covi, et. al. In this variation, the windings consist of one turn each, formed by high current bus bars on the output of a dc—dc converter. Each bus bar passes once through each window. The center leg of the E—E core is gapped to accommodate the differential flux associated with the large dc current being carried by the bus bars, while the high effective permeability of the path surrounding both bus bars provides a common-mode inductance to attenuate common-mode noise on the bus bars. Again, there is no provision for damping the differential-mode inductance, and it may be necessary to grind a large gap.

Another body of prior art uses a combination of two different materials in the core to obtain improved EMI filtering. Most of the examples of this type of prior art are not structures which could provide the function of an integrated common-mode-differential-mode inductor. For example, Siemens core R25/15 and Micrometals ST cores are each composed of two toroid or ring cores, of different materials but matching inner and outer diameters, fastened together. The different reluctances of the two toroid flux paths appear in parallel. Flux can shift from one path to the other, and is not required to pass through both. The intent is to provide attenuation over a larger frequency range than can be obtained from a single material, and to provide some gradual loss of inductance or "swinging choke" type behavior in the presence of significant flux levels from dc or ac power which may saturate one toroid. These structures are not intended to function as an integrated-magnetic assembly, and cannot provide both common-mode and differential-mode inductance.

U.S. Pat. No. 5,083,101 to Frederick shows a magnetic assembly for an integrated filter inductor, using two toroids of different materials. One toroid is nested inside the other. The outer diameter of the inner toroid is less than the inner diameter of the outer toroid, to permit one winding to be wound on the outer toroid, which is intended to provide common-mode inductance, and one winding to be wound around both the outer and inner toroid, which is intended provide differential-mode inductance. This assembly is difficult to fabricate, and fails to maintain the desired balance and symmetry essential to enable clear understanding and to facilitate design.

The present invention satisfies a long felt and heretofore unsatisfied need in the field of electromagnetic interference filter design for an integrated lossy filter inductor. The present invention provides the ability to use magnetic materials of different permeabilities in combination to provide common-mode inductance and differential-mode inductance and damping for noise attenuation, in an assembly that is easy to fabricate.

SUMMARY

An object of the invention is to provide a two-winding, integrated-magnetic EMI filter that has damped common-mode and differential-mode inductances. The preferred embodiment of the filter has a magnetic core structure that incorporates a high-permeability C-core, a high-permeability I-core, and a low-permeability, lossy shunt.

The three core pieces are assembled so as to form a structure that, similar to an E-I configuration, has two winding windows. The loss in the shunt aids in dissipating noise, and it diminishes the effects of unwanted parasitic resonances by providing damping for the differential-mode inductance. Damping for the common-mode inductance is provided by losses in the C and I core pieces. Varying the reluctance of the shunt allows the differential mode inductance to be adjusted separately from the common-mode inductance in order to tune the filter to remove desired noise frequencies.

A second object of the invention is to provide a magnetic component that is easier to manufacture than prior-art filters which utilize an air gap produced by grinding the center leg of an E-core piece. The grinding operation can be been reduced or eliminated by using a shunt formed with a low-permeability material such as powdered iron, which permits the air gap to be reduced or eliminated while still avoiding saturation due to input currents.

The invention provides an integrated-magnetic assembly for a filter having improved damping comprising a C-core having an upper portion, a first leg and a second leg. An I-core is positioned adjacent to the first and the second legs to form a magnetic flux path between the first and second legs. The C-core has a first permeability and the I-core has a second permeability. A shunt core has a third permeability that is less than either the first permeability or the second permeability. The shunt is positioned between the C-core and the I-core to form a shunt magnetic path between the C-core and the I-core. A first winding encircles the I-core between the first leg and the shunt; a second winding encircles the I-core between the second leg and the shunt.

The invention also provides an integrated-magnetic assembly for use in an improved damping filter comprising a toroid core, having a circular bore, and a first permeability. A shunt has a second permeability. The shunt is placed across a diameter of the circular bore to form a shunt magnetic path. The shunt and the toroid core define a first window and a second window. A first winding is wound around the toroid core, passing through the first window, and a second winding is wound around the toroid core, passing through the second window.

BRIEF DESCRIPTION OF THE DRAWINGS

These and other features, aspects and advantages of the present invention will become better understood with regard to the following description, appended claims and accompanying drawings where:

DETAILED DESCRIPTION OF THE PREFERRED EMBODIMENTS

Figure 2:
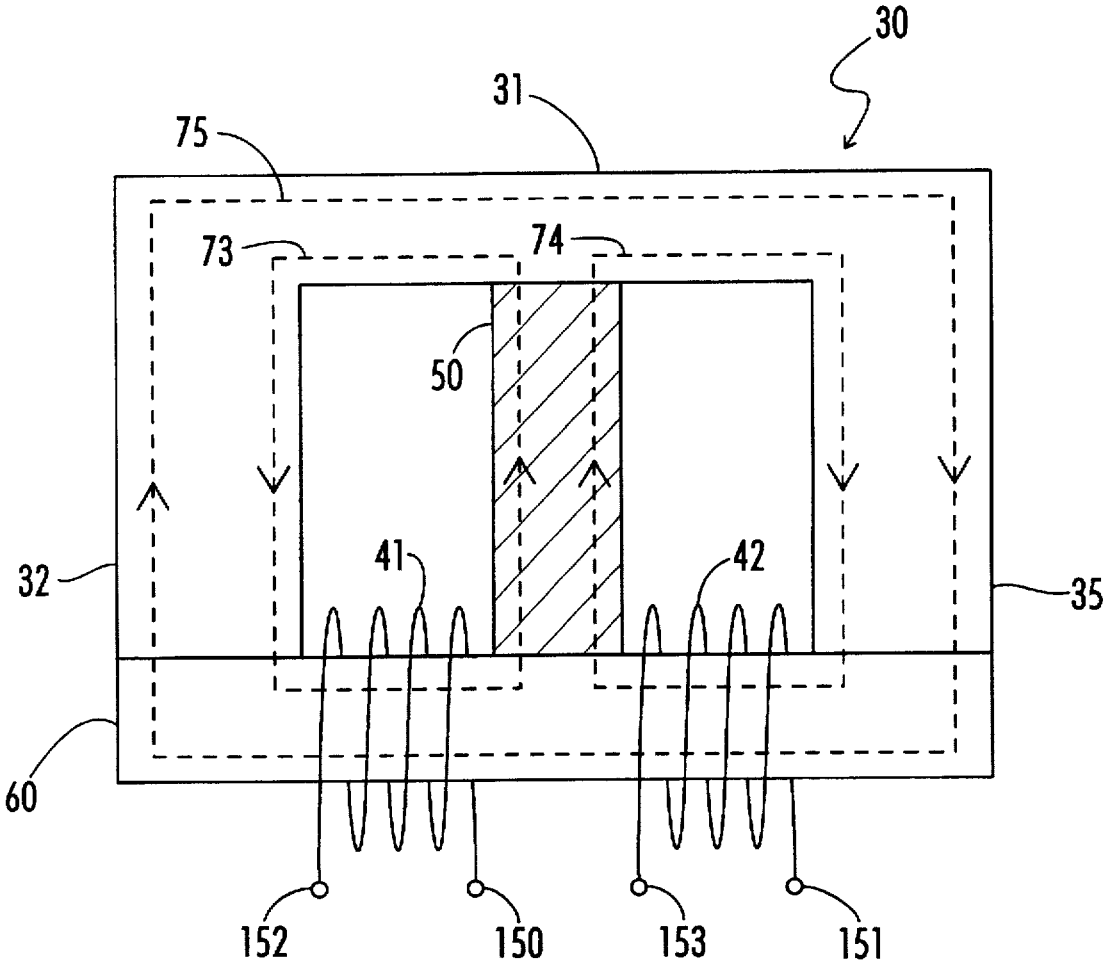
FIG. 2 shows the preferred embodiment of an integrated-magnetic EMI filter that uses a high-permeability C-I core and a low-permeability shunt.

Referring to FIG. 2, an integrated-magnetic EMI filter is shown. In the preferred embodiment of the invention, a C-core and an I-core with windings are assembled with a low-permeability shunt placed between the two windings. The filter has a three-part core comprised of a C-core 30, an I-core 60, and a low-permeability shunt, 50. C-core 30 has an upper portion 31. Attached to this upper portion is a first leg 32 and a second leg 35. A first winding, 41, and a second winding, 42, are formed, preferably on a bobbin that is not shown. Winding 41 has a start terminal 152 and a finish terminal 150. Winding 42 has a start terminal 153 and a finish terminal 151. Windings 41 and 42 could alternatively be wound on legs 32 and 35, but two bobbins would be required. An I-core 60 is inserted into windings 41 and 42. The positioning of shunt 50 can be accomplished in two ways. Shunt 50 can be inserted into a bobbin compartment that is between windings 41 and 42. Alternatively, Shunt 50 may be glued C-core 30. In either case, C-core 30 is placed adjacent to I-core 30 to form a magnetic flux path between legs 32 and 35.

The lengths of core legs 32 and 35, and the length of shunt 50 should be adjusted so that, when assembled, there is no gap between the C-core and the I-core, and the gaps between the shunt and the other two core pieces are minimal. The gaps on either side of the shunt can be minimized by the following process. The shunt is first glued the C-core to form a composite core. The legs of the composite core are then ground simultaneously to form three smooth, co-planar surfaces. As an alternative to the composite-core construction method, a bobbin with a suitable compartment could be used to hold a previously-sized shunt in place.

Instead of having a large air gap in the center leg of an E-core as in prior-art filters, shunt 50 is composed of a material such as powdered iron that has a relative permeability ranging from approximately 10 to 125. Besides having a low relative permeability, powdered iron has the useful property that it can provide significant loss to damp undesired reactive resonances. In order to provide high common-mode inductance, the C-core and the I-core should each be formed with a high-permeability material.

Flux lines 73, 74, and 75 illustrate the magnetic paths taken by the differential-mode flux and the common-mode flux. First differential-mode flux 73 goes through the shunt, a section of the upper portion 31, leg 32 and I-core 60. With the direction shown, this flux would be produced by a positive current flowing into terminal 150. Second differential-mode flux 74 goes through the shunt, a section of the upper portion 31, leg 35 and I-core 60. With the direction shown, this flux would be produced by a positive current flowing into terminal 153. Common-mode flux 75 goes through I-core 60, leg 35, upper portion 31, and leg 32. With the direction shown, this flux would be produced by positive currents flowing into terminals 152 and 153.

Figure 1A:
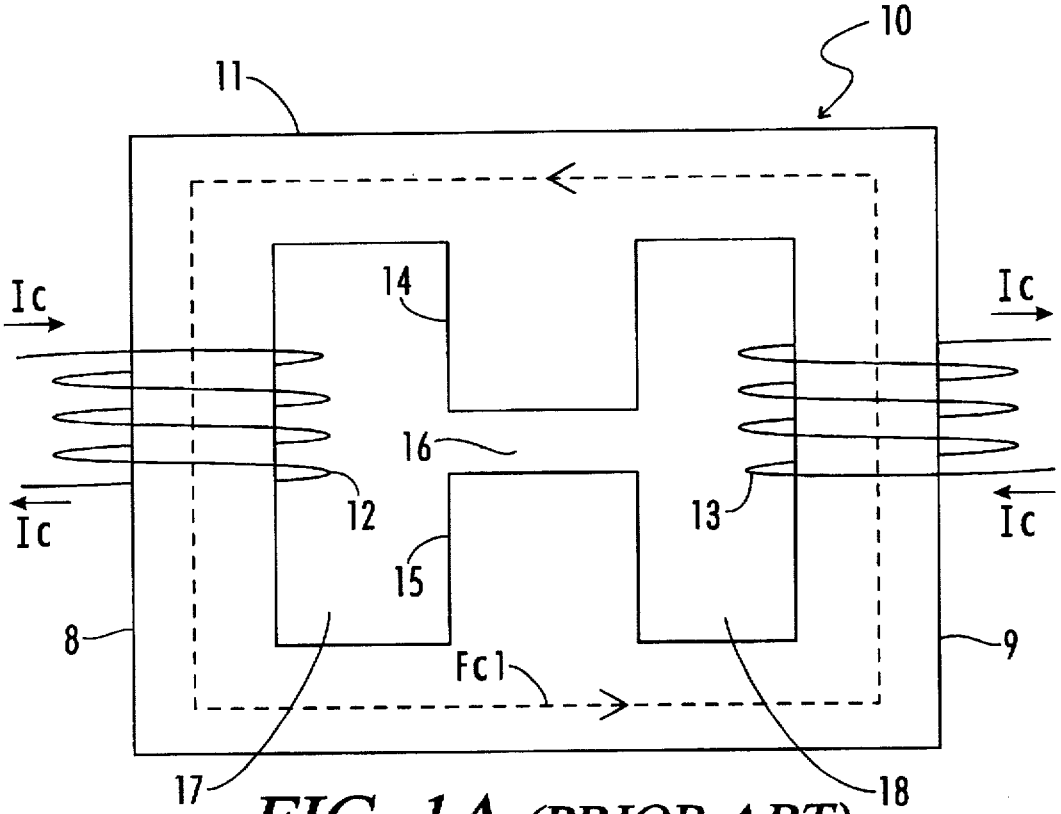
FIG. 1A (PRIOR ART)
FIG. 1A shows a prior-art integrated-magnetic EMI filter with common-mode currents.
Figure 1B:
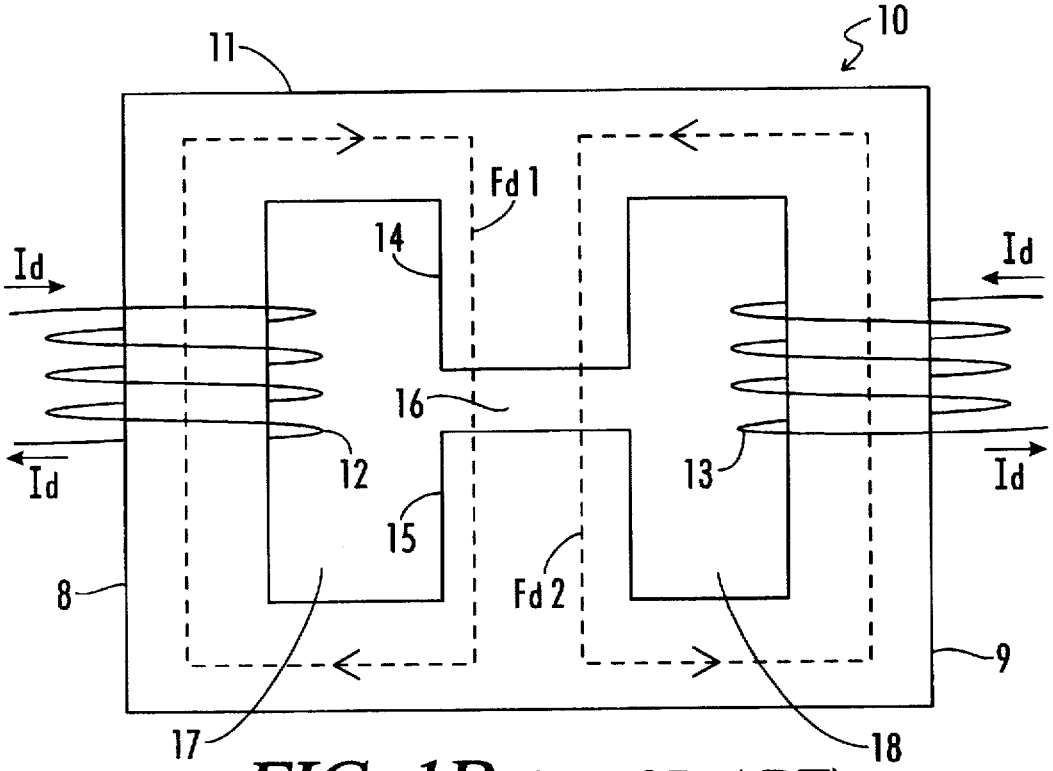
FIG. 1B (PRIOR ART)
FIG. 1B shows a prior-art integrated-magnetic EMI filter with differential-mode currents.
Figure 3A:
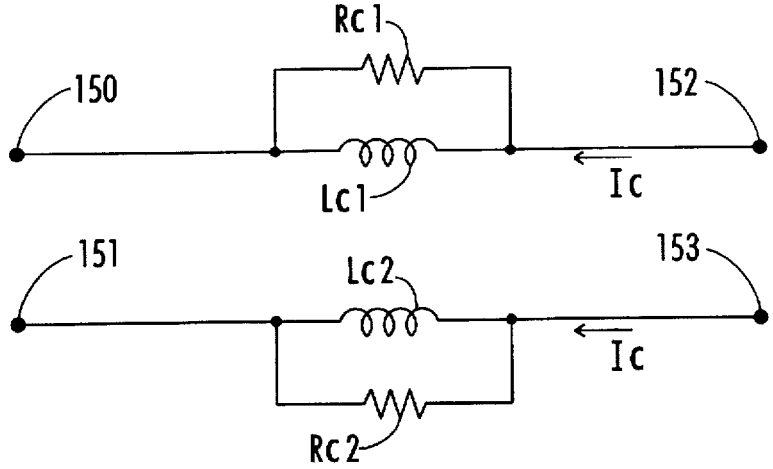
FIG. 3A is a schematic diagram of an equivalent circuit model for common-mode currents.
Figure 3B:
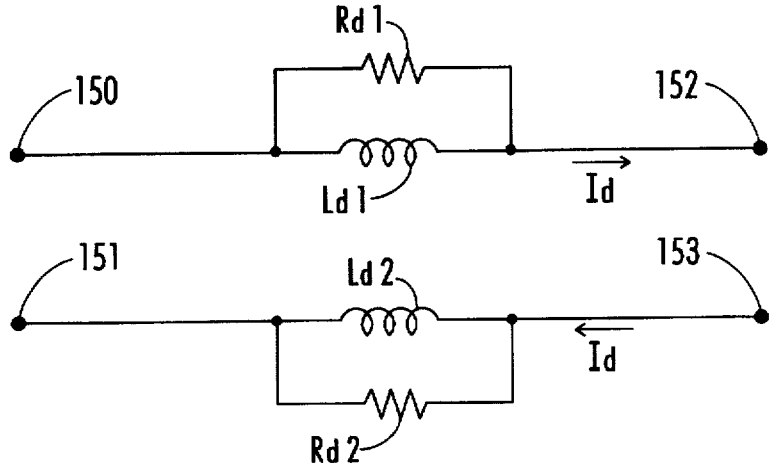
FIG. 3B is a schematic diagram of an equivalent circuit model for differential-mode currents.

The integrated-magnetic filters of the present invention are to intended be used in combination with filter capacitors in a manner familiar to those skilled in the art of EMI filter design. It is useful to model the integrated-magnetic filter when designing an EMI filter circuit. FIGS. 3A and 3B show equivalent circuits that can be used to model two-winding integrated-magnetic EMI filters such as those shown in FIGS. 1, 2, and 4. The existence of multiple flux paths in the core structures of these filters makes it necessary to have two circuit models when the core losses attributable to the multiple paths are to be modeled. FIG. 3A is for common-mode currents, and FIG. 3B is for differential-mode currents. Terminals 150, 151, 152, and 153 correspond to the winding terminals shown in FIG. 2.

Referring to FIG. 3A, common-mode noise currents designated Ic flow into terminals 152 and 153. (Since noise currents are alternating currents, the current directions will reverse during a cycle, but will retain the relative directions.) These currents flow in the same direction in the hot and neutral input power lines, returning through the ground connection. The integrated filter inductor presents an inductive impedance, represented by Lc1 and Lc2, to the common-mode noise in each line. The core loss, which can help dissipate the noise and damp parasitic resonances, is represented by the resistors Rc1 and Rc2 in parallel with Lc1 and Lc2, respectively. It is standard practice to represent core loss by a resistor in parallel with the winding, in contrast to winding loss, which is represented by a resistor in series with the winding. In the parallel position, the lower the resistor value, the more loss, other values being equal. Because core permeabilities vary with frequency, the values of the components in the models also vary with frequency.

Referring to FIG. 3B, differential-mode noise currents designated Id flow into terminals 150 and 153. These currents flow in opposite directions in the hot and neutral input power lines, with no contribution to the noise current in the ground path. The integrated inductor of the present invention introduces an inductive impedance, represented by Ld1 and Ld2, to the differential-mode current in each line. The core loss for the differential-mode noise current is represented by the resistors Rd1 and Rd2, in parallel with Ld1 and Ld2, respectively.

In order to illustrate the advantages of the present invention, two integrated magnetic filter designs were modeled using the circuits of FIGS. 3A and 3B. The first design is a prior art configuration based on the teachings of the Upadhyay patent. The second design corresponds to the preferred embodiment of the present invention shown in FIG. 2.

Both designs were based on the following constraints. The model component values were calculated at a frequency of 500 kHz. The filters were designed to carry a differential current having a peak value of 0.8 A at 60 Hz. Both designs use ferrite for two of the core pieces, and the peak value of the 60 Hz flux density in the ferrite was set at 2500 gauss. Both of the windings in the two cases were chosen to have 120 turns. For simplicity, all mating surfaces in the two designs were assumed to have negligible air gaps.

The first integrated inductor to be modeled uses a typical ferrite E-I core set in which the center leg of the E-core has a cross-sectional area of 40 $mm^2$. At 500 kHz, the complex relative permeability of the selected ferrite core material has a value of approximately 3000-j750. The E-core has an air gap in the center leg in order to introduce reluctance which limits the flux from differential ac line currents. It was calculated that a gap length of 0.47 mm would produce a peak flux density of about 2500 gauss at 0.8 A differential current.

The second integrated inductor, which is based on FIG. 2, utilizes a C core having the same dimensions as the E-core used in the first inductor, except that the center leg is missing. The center leg is replaced by a powdered iron shunt. Given that the air gaps were assumed to be negligible, the length of the shunt is fixed by the dimensions of the C-core. The available parameters for setting the reluctance of the differential path are the permeability and the cross-sectional area of the powered iron shunt. The selected powered iron material has a complex permeability of approximately 55-j11 at 500 kHz. It was calculated that a cross-sectional area of 18.8 $mm^2$ would produce a peak flux density of about 2500 gauss in the ferrite at 0.8 A. differential current. Because the cross-sectional area of the powdered iron is less than half of the cross-sectional area of the center leg of the E-Core used in the first design, while the flux in the ferrite portions of the two designs are equal, the flux density in the powdered iron is more than twice the flux density in the ferrite. Fortunately, powdered iron can accommodate much higher flux levels than ferrite.

The calculated values of the model components for the two designs are shown in Table 1. The inductor and resistors representing core loss in the common-mode are unchanged since the common-mode flux does not traverse the powdered iron core portion. The differential inductance is unchanged because the reluctance value of the shunt was adjusted to match that of the gapped E-core. The only component values that changed are those of the differential damping resistors, Rd1 and Rd2. The differential damping resistors of the present invention have values that are more than 50 times lower than those of the prior art. This results in considerably more damping for the present invention than for the prior art. The reason for this is that in the prior art design, the magnetic reluctance of the gap dominates the reluctance of the differential flux path. The lossiness of the air, which is negligible, rather than the loss of the ferrite, thus dominates the resistive part of the differential impedance which the integrated inductor presents to a filter circuit. The loss tangent of the differential-mode inductance is therefore considerably smaller than the loss tangent of the common-mode inductance.

For the present invention, the loss tangents for the common-mode and differential mode circuit models are actually of similar magnitudes. Although the values of the common-mode damping resistors are considerably higher than those of the differential mode resistors, the common mode inductances are also much higher.

TABLE 1

Model Component Values

| | Design 1 Prior Art | Design 2 Present Invention |
|---|---|---|
| Lc1, Lc2 | 32 mH | 32 mH |
| Rc1, Rc2 | 410 kΩ | 410 kΩ |
| Ld1, Ld2 | 746 μH | 746 μH |
| Rd1, Rd2 | 304 kΩ | 12 kΩ |

Although this specific illustration used a design with no air gaps, it should be understood that in fabrication there will always be incidental gaps from imperfect assembly of the core. It will be appreciated that the advantages of the present invention can be obtained even in the presence of incidental gaps or with designs which use one or more deliberate air gaps in the center leg. These advantages will be obtained as long as the magnetic reluctance of the differential flux path is dominated by the lower permeability, lossy, material and not by the reluctance of any air gaps.

Several advantages arises from the use of the present invention. First, using a lossy shunt material improves noise damping without the cost of additional components, and with no reduction in differential-mode inductance. Second, using a shunt of a low-permeability material such as powdered iron permits the air gap to be reduced or eliminated while still avoiding saturation due to input currents. This results in a magnetic component that is easier to manufacture, since the extra grinding operations which produce the gap by shortening the center leg have been reduced or eliminated. Third, the area of the center leg can be reduced, since the powdered iron can tolerate higher flux density than the ferrite. This reduced area creates a larger window for the winding, or permits the reduction of the overall size of the component.

Figure 4:
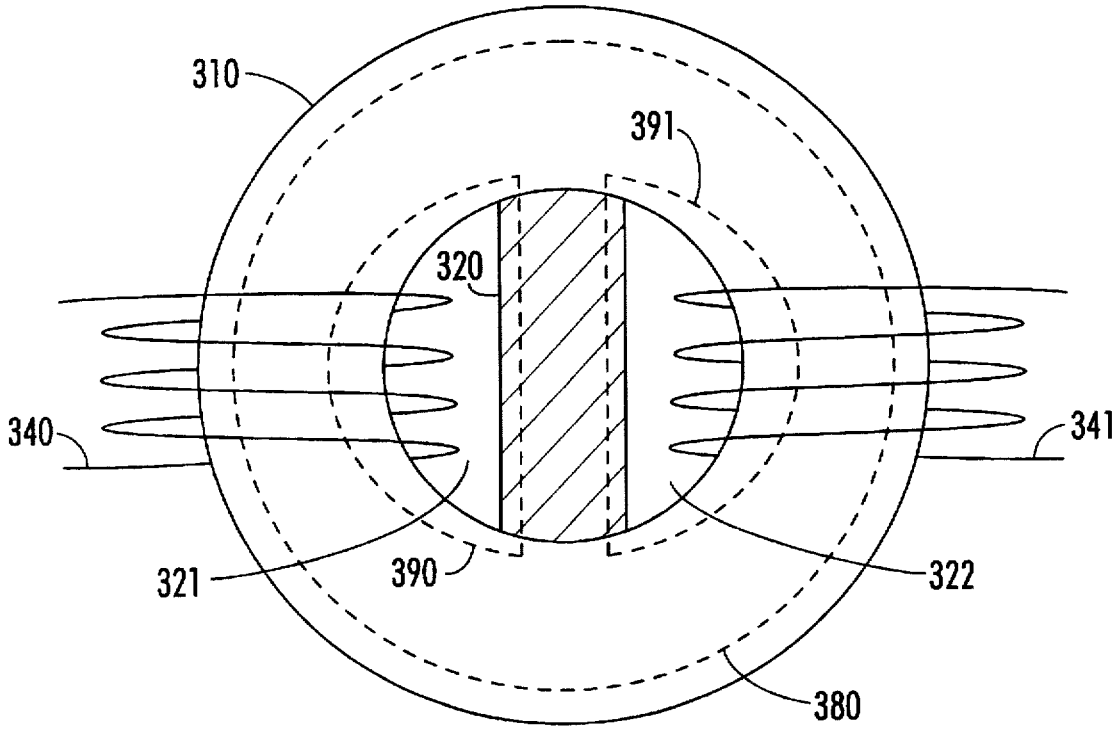
FIG. 4 shows an embodiment of the invention that has a toroid core with a low-permeability shunt.

FIG. 4 shows another embodiment of the invention that uses a high-permeability toroid core 310 in place of the C and I cores. This embodiment can produce high common-mode inductances with fewer turns than the structure of FIG. 2. A low-permeability shunt 320 is placed inside toroid 310, and it divides the winding area into two windows, 321 and 322. A first winding 340 is wound on toroid 310, passing through window 321. A second winding 341 passes through window 322.

Flux lines 380, 390 and 391 illustrate the magnetic paths taken in the toroid structure by the common-mode flux and the differential-mode flux. Flux line 390 shows the differential-mode flux path for winding 340 which passes through half of toroid 310 and through shunt 320. Differential flux line 391, which corresponds to winding 341, passes through the other half of toroid 321 and shunt 320. Common-mode flux line 380 is produced by both windings 342 and 341, and stays within the toroid.

As with the structure of FIG. 2, the advantages of the present invention can be obtained even in the presence of incidental gaps or with designs which use deliberate air gaps in series with the shunt. These advantages will be obtained as long as the magnetic reluctance of the differential flux path is dominated by the lower permeability, lossy shunt material and not by the reluctance of any air gaps.

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. An integrated-magnetic assembly for a filter having improved damping comprising:

a C-core having an upper portion, a first leg and a second leg, the C-core having a permeability;

an I-core positioned adjacent to the first and the second legs to form a magnetic flux path between the first and second legs, the I-core having a permeability;

a shunt core having a permeability, the permeability of the shunt core being less than either the permeability of the I-core or the permeability of the C-core, the shunt core positioned between the C-core and the I-core;

a first winding encircling the I-core between the first leg and the shunt core;

a second winding encircling the I-core between the second leg and the shunt core;

a shunt magnetic path formed between the C-core and the I-core, the shunt magnetic path having at least one air gap, the shunt core having a reluctance, the air gap having a reluctance, the shunt magnetic path having a reluctance, the reluctance of the shunt magnetic path being a sum of the reluctance of the air gap and the reluctance of the shunt core, the reluctance of the shunt magnetic path primarily determined by the magnitude of the reluctance of the shunt core.

2. The magnetic assembly according to claim 1 in which the first winding, the second winding, the C-core and the I-core provide a common-mode inductance, and the shunt magnetic path provides a damped differential mode inductance.

3. The magnetic assembly according to claim 1 in which the permeability of the shunt core has a relative permeability constant between 10 and 125.

4. An integrated-magnetic assembly for use in an improved damping filter comprising:

a toroid core, the toroid core having a circular bore, the toroid core further having a permeability;

a shunt core having a permeability, the shunt placed across a diameter of the circular bore, the shunt core and the toroid core defining a first window and a second window;

a first winding wound around the toroid core, the first winding passing through the first window;

a second winding wound around the toroid core, the second winding passing through the second window;

a shunt magnetic path formed across the circular bore of the toroid core, the shunt magnetic path having at least one air gap, the shunt core having a reluctance, the air gap having a reluctance, the shunt magnetic path having a reluctance, the reluctance of the shunt magnetic path being a sum of the reluctance of the air gap and the reluctance of the shunt core, the reluctance of the shunt magnetic path primarily determined by the magnitude of the reluctance of the shunt core.

5. The magnetic assembly according to claim 4 in which the first winding, the second winding, and the toroid core provide a common-mode inductance, and the shunt magnetic path provides a damped differential mode inductance.

6. The magnetic assembly of claim 4 wherein the permeability of the shunt core has a relative permeability constant between 10 and 125.

* * * * *